US006328009B1

(12) United States Patent
Brothers

(10) Patent No.: US 6,328,009 B1
(45) Date of Patent: Dec. 11, 2001

(54) VALVE LIFTER APPARATUS

(75) Inventor: Paul Brothers, Memphis, TN (US)

(73) Assignee: Competition Cams, Inc., Memphis, TN (US)

( * ) Notice: Subject to any disclaimer, the term of this patent is extended or adjusted under 35 U.S.C. 154(b) by 0 days.

(21) Appl. No.: 09/454,464

(22) Filed: Dec. 3, 1999

Related U.S. Application Data

(63) Continuation-in-part of application No. 09/203,015, filed on Dec. 1, 1998, now Pat. No. 6,209,498.

(51) Int. Cl.[7] ..... F01L 1/14; F01M 9/10

(52) U.S. Cl. ..... 123/90.35; 123/90.48; 123/90.5; 184/6.9; 74/569

(58) Field of Search ..... 123/90.35, 90.48, 123/90.49, 90.5; 184/6.5, 6.9; 74/569

(56) References Cited

U.S. PATENT DOCUMENTS

| | | | | |
|---|---|---|---|---|
| 3,314,303 | * | 4/1967 | Maat | 74/569 |
| 4,708,102 | * | 11/1987 | Schmid | 123/90.35 |
| 4,809,651 | | 3/1989 | Gerchow et al. | 123/90.5 |
| 5,022,356 | * | 6/1991 | Morel, Jr. et al. | 123/90.5 |
| 5,127,374 | * | 7/1992 | Morel, Jr. et al. | 123/90.35 |
| 5,188,068 | * | 2/1993 | Gaterman, III et al. | 123/90.35 |
| 5,566,652 | * | 10/1996 | Deppe | 123/90.35 |
| 5,673,661 | * | 10/1997 | Jesel | 123/90.48 |
| 5,797,364 | * | 8/1998 | Meek et al. | 123/90.36 |
| 5,806,475 | | 9/1998 | Hausknecht | 123/90.16 |

* cited by examiner

*Primary Examiner*—Weilun Lo
(74) *Attorney, Agent, or Firm*—Banner & Witcoff, Ltd.

(57) ABSTRACT

A valve lifter apparatus is provided including a valve lifter body with predetermined oil paths for increase lubrication to a rolling member for engaging a lobe of a camshaft. An anti-rotation member for prevent rotation of the valve lifter in the lifter bore of the engine block as the valve lifter reciprocates is also provided. The valve lifter apparatus may be employed in high revolutions per minute engines to decrease valve lifter wear and increase performance.

3 Claims, 5 Drawing Sheets

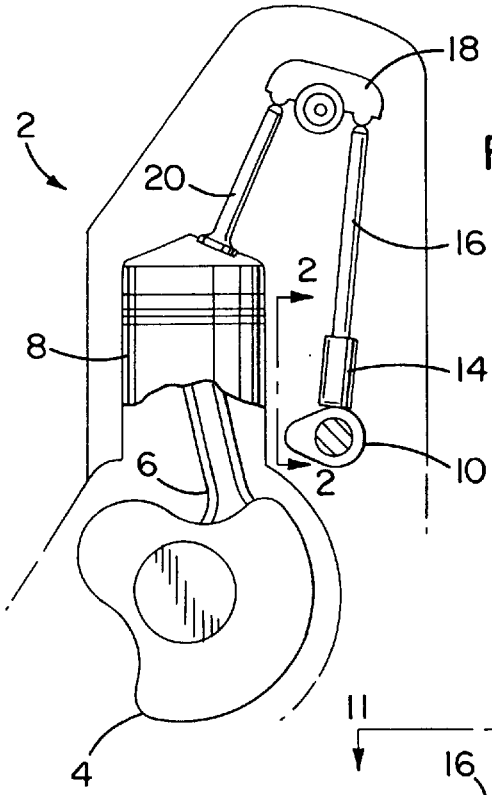
FIG. 1
FIG. 2
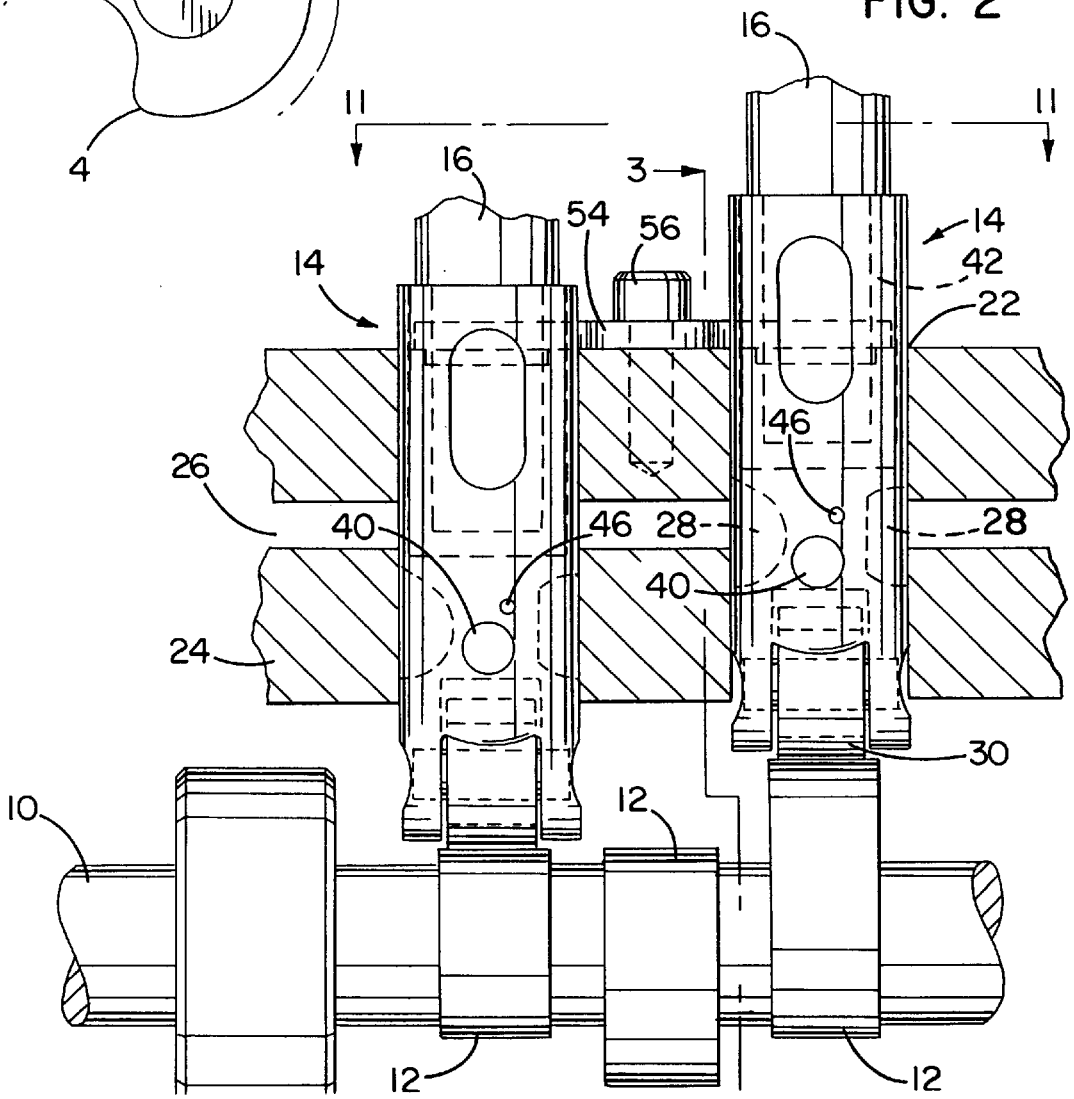

FIG. 10
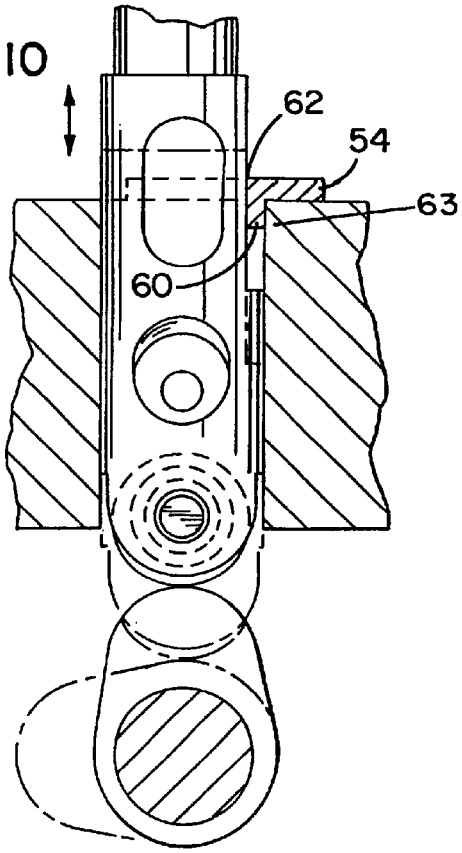
FIG. 11
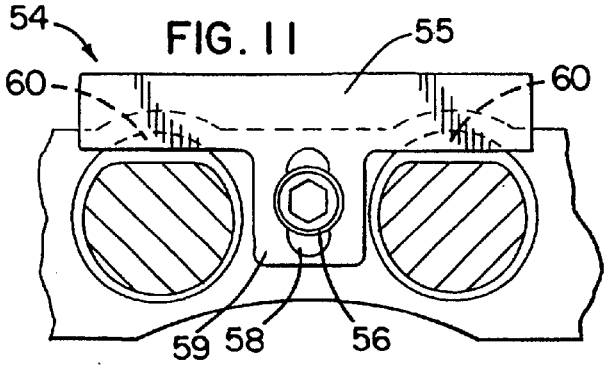
FIG. 12
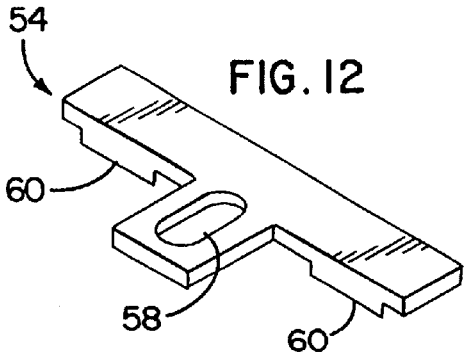
FIG. 13
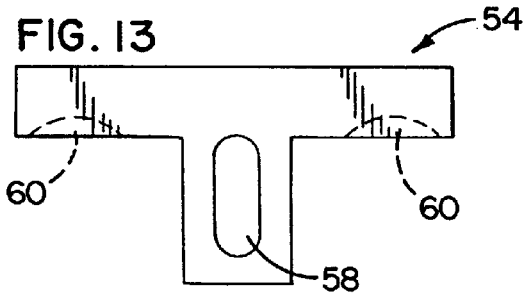
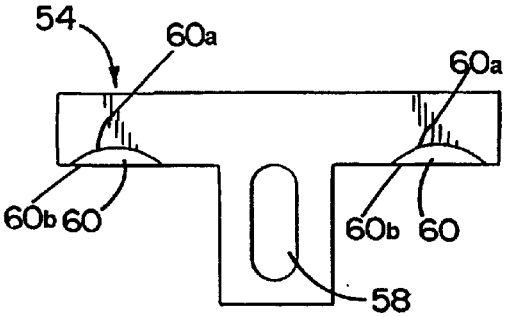
FIG. 14
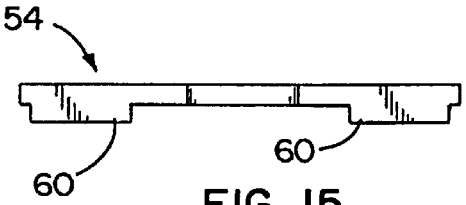
FIG. 15
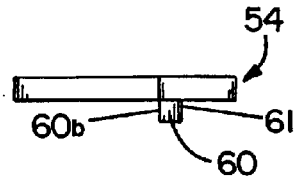
FIG. 16

VALVE LIFTER APPARATUS

RELATED APPLICATION

This application is a continuation-in-part of patent application Ser. No. 09/203,015, filed Dec. 1, 1998, now U.S. Pat. No. 6,209,498.

FIELD OF THE INVENTION

The present invention relates to a roller valve lifter having a roller at one end thereof that cooperates with a lobe of a camshaft in an internal combustion engine. More specifically, the invention relates to improving the lubrication of the valve lifter and preventing rotation of the lifter.

BACKGROUND OF THE INVENTION

Conventional camshaft or "cam", internal combustion engines typically utilize valve lifters, push rods, and valve springs along with rocker arms to open and close the valves of the engine to allow air and fuel to enter and exhaust to exit the cylinders of the engine during combustion. These components are collectively referred to as the "valve train."

In conventional cam engines as opposed to those of over-head design, a valve lifter with a pushrod rides on the lobes of the camshaft which is rotated by the crankshaft. As the lifter reciprocates up and down, the push rod seated in the lifter also reciprocates and communicates this up and down motion via a rocker arm to either an intake or exhaust valve. A high tension spring ranging from approximately 200 to 1000 ft·lbs, surrounds the stem of the valve and when the spring is compressed, the valve is pushed into the cylinder.

During the up stroke of the piston in the cylinder, the intake valve opens to allow fuel and air to enter the combustion chamber. Somewhere near the very top of the up stroke, both the intake and the exhaust valves close and the spark plug creates a spark to ignite the air-fuel mixture which is under compression by the piston. This results in a high temperature explosion which forces the piston downward, called the "power stroke," thereby translating this movement via a connection rod to rotate the crankshaft which, in turn, translates this angular motion to the wheels of the vehicle via a set of gears. Near the bottom of the compression stroke, the exhaust valve opens to expel the burnt fuel mixture out of the cylinder. After the piston changes directions and begins the up stroke, the exhaust valve continues to remain open thereby forcing any remaining the spent gases out of the cylinder. However, during this same time, the intake valve begins to open to recharge the cylinder with fuel. It is not until the piston has started to travel upward that the exhaust valve closes. Thus, at various times during the compression cycle, both the intake and exhaust valves will be open and closed at the same time. The timing of the opening and closing of the valves is controlled by the physical design of the oval shaped lobes on the camshaft. As the valve lifter is pushed upward by the lobe of the camshaft, the valve lifter pushes the pushrod up which drives the rocker arm downward, causing the valve to open. Likewise, as the lifter and pushrod travel downward, the rocker arm raises and the valve closes due to the biasing action of the valve spring.

In high speed engines, measured as revolutions per minute (RPM), the valve train components are under extreme stress and high temperatures. To increase engine performance and decrease component wear which may eventually lead to failure, various valve lifter configurations have been designed. Solid and hydraulic valve lifters are the most common designs used in conventional cam engines. Hydraulic lifters are typically used in relatively low RPM engines, up to 6,500, whereas solid valve lifter designs are preferred in high RPM applications such as racing and high performance applications. Conventional hydraulic and solid lifters have a flat surface that is fixed or integral with the body of the lifter and is adapted to engage and ride on the lobes or the camshaft. The engagement between the fixed surface of the lifter body and the camshaft lobe creates high frictional forces causing the surfaces of the lobes to wear. Therefore, the higher the RPM of the engine, the greater the wear and the likelihood of material being removed. As material is removed from the surface of the lobe, the timing of the opening and closing of the valve also changes. This change in timing may hamper engine performance such as by allowing excess air-fuel mixture to enter the cylinder causing a rich condition. Conversely, improper timing may permit the air-fuel mixture to escape through the exhaust valve which results in a lean condition. Either of these conditions will affect cylinder pressure and decrease performance and may cause misfiring of the cylinder and engine damage. Furthermore, if this improper timing allows a valve to remain open when the piston is near the top of the compression stroke, the piston will strike the valve resulting in bent pushrods and valves, broken valve springs and lifters and will eventually lead to catastrophic engine failure.

To decrease lobe wear in high performance engines, a roller has been added to the body of the valve lifter for riding on the cam. The roller allows the use of a camshaft with lobes of steeper ramp angles to provide faster valve opening and closing for accommodating high RPM engines. The roller engagement between the roller and rotating cam lobe reduces the fictional forces generated therebetween. Not only does the presence of the roller decrease cam lobe and valve lifter wear, it also provides smoother transitions as the roller travels over the peak of the lobe thereby decreasing valve train noise. Likewise, various bearing and sleeve configurations have been utilized to decrease friction and wear of the shaft rotatably mounting the roller to the valve lifter. For high performance engines, needle bearings have replaced solid rollers, bushing and conventional ball bearings to decrease wear and more evening spread the load over the surface of the shaft. However, these bearings and bushings also rely upon oil to function properly.

Although the addition of the roller increases camshaft and valve train life, overall roller wear is a function of engine speed (RPM). High performance engines such as those used in drag racing applications produce extremely high engine speeds (6,000 to 13,000 RPM) over a short duration of time (i.e. less than 5 to 12 seconds). Conversely, stockcar racing engines produce relatively high engine speeds of typically 5,000 to 8,000 RPM and under racing conditions, maintain those speeds for long periods of time (2 to 3 hours). At these high engine speeds, it becomes difficult to provide oil to the valve lifter, roller and bearing assembly as well as adequate lubrication of the camshaft.

From the ground up, a typical engine is configured with an oil pan for holding oil and an oil pump which feeds the oil to various locations in the engine. Above the oil pan sits the engine block and the crankshaft, such that a portion of the crank rotates in the oil. In a typical "V"-style engine, that is, one having cylinders at an angle to the left and right sides of the block in a "V" pattern with the crankshaft positioned at the apex of the "V", the camshaft is typically located directly above and in parallel with the crank. In straight cylinder configuration engines wherein all cylinders are aligned in a row, the crankshaft and cylinders are located in the same plane and camshaft is positioned to one side so not to interfere with the travel of the connecting rods.

The valve lifters, in an "V" style engine, are located in a lifter galley. The lifters are lubricated by oil in the engine block and receive direct lubrication from a transverse oil passageway in the engine block that intersect the bores in which the valve lifters are positioned and indirectly from oil that is sprayed into the lifter galley from the rotation of the crankshaft and connecting rods. Various methods have been employed to increase the lubrication of the valve lifters and camshaft.

One method used to increase the movement of oil to the valve lifters and camshaft is the addition of small holes to the crankshaft and the dynamic balance weights of the crank. These holes, or oil squirters, pickup oil from the pan and any oil on the surface of the crank and throw the oil to the camshaft and valve lifter as the crankshaft and rotates. This method is also employed in engines having steel connecting rods to lubricate the cylinder wall by placing a through-hole on the end that connects to the piston and to the lifters by adding a squirter to the "big end" or end that connects to the crankshaft. However, the machining of the squirter reduces the strength of the connecting and have been found to severely weaken aluminum connecting rods used in high performance, high RPM engines.

Another method of directing oil to the lifters and camshaft involves adding separate oil feed lines to the lifter galley. This is accomplished by drilling a feed hole into an oil passageway of the engine block to tap the oil pressurized by the oil pump and adding metal tubing to direct the oil to the desired location such as above the camshaft. However, adding components to the internals of engine is not always practical due to the limited amount of space. Furthermore, these added components may also fail and create shrapnel that will be run through the engine which can damage precision surfaces such as in the camshaft, crankshaft, pistons, etc.

To increase the movement of oil in the common transverse oil passageway and lifter bores, the valve lifter body has been modified. One modification includes adding a channel through the body of the lifter to increase the amount of flow of oil from one passageway to the next lifter bore. Another method of facilitating the flow of oil in the common passageway while increasing lubrication to the lifter is by adding an annular groove to the body of valve lifter. As the valve lifter reciprocates in the bore, the oil trapped between the space created by the annular groove and the bore is deposited on the walls of the bore.

With all of these methods, the higher the RPM, the greater the oiling of the valve lifter; however, at low engine speeds such as during idling, start-up, stop-and-go driving conditions, and gear shifting create inadequate lubrication conditions. Not only are these types of driving conditions prevalent on race day, but also seen during every day driving. Therefore, a method is needed to provide adequate lubrication to the roller and the bearing assembly thereof to reduce wear, maximize engine performance and avoid valve train component failure.

Another problem associated with the use of solid valve lifters with rollers in high RPM engines, is the rotation of the lifter as it reciprocates in the lifter bore of the engine. At high RPM the valve lifter has a tendency to rotate so that its axis of rotation becomes skewed or out of parallel alignment with that of the camshaft and lobes thereof. Also, the use of steep angled camshaft lobes require extremely high valve spring pressures. Any misalignment of the roller with the engaging surface of the camshaft lobe may lead to catastrophic failure of the roller causing significant damage to the camshaft and bent pushrods and valves and broken rocker arms and valve springs. Also, rotation of the lifter in the bore may prevent the oil pressure feed receiving area or groove of the valve lifter from intersecting and the common transverse oil passageway of the engine block that feeds oil to the valve lifters.

To prevent rotation in the bore, link bars are commonly used to tie the bodies of two lifters together, typically the exhaust and intake of one cylinder. These link bars may be permanently attached to the lifters or removable such as shown in U.S. Pat. No. 4,809,651. Although these prior link bars prevent rotation, they also add components and weight to the lifter assembly. Furthermore, the attachment point of the link bar to the body also wears due to the repetitive motion and may eventually fail. Furthermore, in high revolutions engines, these link bars on the valve lifters are constantly fighting rotation and under repetitive forces. Thus, in applications requiring high engine speeds over long durations of time, the link bar and the attachment devices may fatigue creating unnatural movement of the lifter which will damage the valve train.

Another method used to prevent rotation of the lifter is by adding a "U" shaped member in which the legs of the "U" are inserted into two adjacent lifter bores as illustrated in U.S. Pat. No. 5,022,356. The legs of this anti-rotation member are smaller than the diameter of the lifter bore and longer than the bore length. Once inserted in the lifter bore, the member is push to the front or rear of the bore and, thus, the member makes contact with the entire length of lifter bore on each end side of the member leg. The member is prevented from falling through the bores by a cross-member that connects the two legs. Also, a foot is added at the end of the member to prevent tho member from exiting the lifter as the lifter travels upward. The valve lifter must also be modified to be used in conjunction with this member. The portion of the valve lifter which engages the member must be machined flat. Although this member and lifter assembly prevents rotation without adding components to the valve lifter body, the member presents other problems. The member edges are in contact with the full length of the lifter bore and the long flat of the valve lifter engages the member. Thus, as the lifter reciprocates, the large area of contact between the member and the lifter create friction thereby requiring additional lubrication to prevent excessive wear and heat. Furthermore, the edges of the member may eventually wear into the lifter bore thereby removing material which is run through the engine. Also, the feet of the member extend through the lifter bore positioning themselves near the camshaft and the roller of the lifter. The height of the feet are, therefore, critical to prevent the lobes of the cam from making contact with them. In high performance engines, a specific cam design is used to create precise opening a closing of the valves for that particular engine configuration. Thus, if an engine is retrofitted with a different camshaft, the feet of the member may also have to be ground to allow clearance by the cam lobes. Therefore, an anti-rotation device which prevents rotation of the lifter but does not add weight and/or components to the valve lifter or those that may interfere with the cam lobes and does not create excess friction and heat is needed for these high performance engines.

SUMMARY OF THE INVENTION

In accordance with the presence invention, a valve lifter apparatus is provided including a body with a roller member at one end thereof for riding on one of the camshaft lobes. The body is provided with a predetermined flow path which direct lubrication in a well-defined manner directly to be end of the body at which the roller member is located. In this manner, lubrication is directed in a predetermined manner to the place it is needed most, i.e. the roller, rather than simply relying on the general undirected travel of the oil fed to the lifter bore.

In another aspect of the invention, a valve lifter assembly is provided including a lifter body which reciprocates in a bore in the engine block. A portion of body of the valve lifter has a flat exterior surface and the assembly includes an anti-rotation member including at least one short portion thereof that extends into the lifter bore adjacent the flat of the valve lifter body to prevent rotation thereof in the bore. As the length of the flat is much greater than the length of the member portion, the flat surface will only have a short section thereof that is in contact with the short member portion at any time during the reciprocation of the valve lifter body. This small area of engagement minimizes the amount of friction and wear caused by the up and down movement of the flat. In this regard, the small engagement area also advantageously requires less oil to keep the surfaces properly lubricated.

As mentioned, the invention contemplates a predetermined flow path for directing lubrication to the roller member, and specifically, the bearing assembly thereof. The predetermined flow path, which in the preferred and illustrated form includes internal oiling channels formed in tie valve lifter body that extend between the oil receiving area on the lifter body and the roller member, avoids the need to add oil squirters or add direct feed oil lines. This is desirable because oil squirters are not practical for use in aluminum and high performance steel connecting rods due to the loss of strength and stress riser resulting from the addition of the hole. Furthermore, the amount of the oil thrown from the squirters decrease as engine speeds decrease and are thereby inefficient if not unreliable.

Alternatively, an external oiling channel can be provided on the surface of the lifter body. This external oiling channel is used to direct oil received by the oil receiving area, which is more preferably, an annular, circumferential groove about the lifter body that intersects the common oil passageway as the lifter reciprocates in the bore. As oil is received in the groove, the external oiling channel directs oil towards the housing portion of the lifter body where it may lubricate the roller and bearing assembly situated therein. Another advantage of using an annular groove and external oiling channel is that any oil thrown on die body of lifter may also be contained by the groove and channel and directed to the roller and bearing assembly.

The oil receiving area is in one form a transverse, through passageway that can be modified by adding of at least two round or oval shaped receiving areas on each side of the lifter body, The oil receiving areas are oriented perpendicular to the rolling direction of the roller, are ramped into the body and intersect the common transverse oil passageway in the engine block which feeds oil to the lifter galley. In the lifter body these oil receiving areas or inlets are connected by a passageway which travels through the body and parallel with the shaft of the roller. Also, additional inlets may be added to the front and back surfaces of the lifter body and connected to the internal passageway to feed additional oil into the passageway. Internal oiling channels have been added in the lifter body to direct the oil feed into the inlets and passageway. The oiling channels originate at the passageway and axially direct the oil through the body to the housing mounting the roller. To increase bearing and shaft life, at least two oiling channels are positioned to deposit oil between the housing and the outward sides of the roller to facilitate lubrication the shaft and bearing and to indirectly the surface of the roller. Additional oiling channels may be added to directly feed oil to the surface of the roller to directly lubricate the roller and camshaft lobes.

To prevent rotation of the valve lifter as it rapidly reciprocates up and down, a small guide or anti-rotation member has been added and fixed to the engine block in the lifter galley. The anti-rotation guide can span across two adjacent lifters and has a substantially flat main portion that sits on top of the engine block outside the bores. A tab extends perpendicular from the middle of the guide and in one form has a slot where a fastener may be inserted and threaded into the block of the engine to hold the guide stationary. Other methods of securing the anti-rotation guide to the block may also be employed. Each end of the guide that spans a lifter bore contains a small, crescent-shaped portion which depends from the main portion to form a shoulder therewith. The small crescent portion extends into the lifter bore with the curved portion of the crescent-shaped portion matching the curvature of the lifter bore to provide secured and flush engagement between the bore walls and the top of the block and the crescent-shaped portion of the anti-rotation member. The portion also a planar bearing surface that mates with the front surface of the lifter for preventing rotation of the body of the lifter in the bore. To increase stability and decrease friction and wear on the valve lifter as it reciprocates, the lifter body has been modified by machining a short, planar surface on the front of the lifter. Due to the small contact surface created by the portion of the anti-rotation guide and only a small portion of the lifter body need be planar. Now, as the lifter reciprocates in the bore, the front planar surface slides across the small planar surface of the anti-rotation guide containing its movement.

Thus, this guide provides an alternative to link bars which not only add excess material to the lifter assembly, but also present the potential for damage to the engine as the bars and attachment members wear due to the constant motion of the assembly. Furthermore, the small contact area created by the crescent-shaped portion minimizes friction and heat created thereof. Also, the guide also allows the mechanic to remove a single valve lifter from the engine by loosening the fastener and lifting and sliding the guide to allow the lifter to clear the guide, conventional link bars require the removal of the lifters as a pair. The capability to remove one lifter at a time is advantageous in engines where the pushrods may be of different lengths for the exhaust and intake valves. The mechanic needs to remove only one valve lifter and pushrod and thereby prevents the inadvertent switching of the pushrods during reassembly.

BRIEF DESCRIPTION OF THE DRAWINGS

FIG. 1 is a schematic view of an internal combustion engine including the valve train thereof;

FIG. 2 is an elevational partial view taken along line 2—2 of FIG. 1 showing a pair of valve lifters apparatuses in accordance with the present invention, the valve lifter apparatuses each including a roller member engaged with respective lobes of a camshaft;

FIG. 10 is a cross-sectional view taken along line 3—3 of FIG. 2 the engagement between an anti-rotation guide and flat of the valve lifter;

FIG. 11 is a cross-sectional view taken along line 11—11 of FIG. 2 showing the anti-rotation guide and a pair of valve lifters;

FIG. 12 is an elevational view of the anti-rotation guide showing a pair of short flat surfaces for engaging the flats of the valve lifters;

FIG. 13 is a plan view of the anti-rotation guide showing a main portion thereof including an attachment slot;

FIG. 14 is a bottom plan view of the anti-rotation guide showing a pair of crescent-shaped portions including the short flat surfaces;

FIG. 15 is a front elevational view of the anti-rotation guide showing the short flat surfaces;

FIG. 16 is a side elevational of the anti-rotation guide showing a portion formed between a curved surface on the crescent portion and the main portion;

DETAILED DESCRIPTION OF THE PREFERRED EMBODIMENTS

Figure 3:
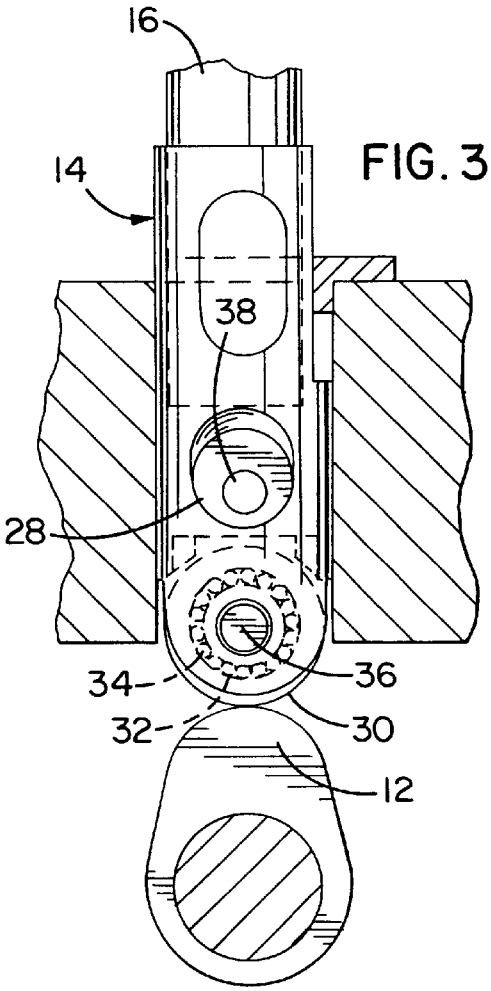
FIG. 3 is a cross-sectional view taken along line 3—3 of FIG. 2 showing a the bearing assembly for the roller member.

A valve lifter as used in an internal combustion engine is used to translate the angular motion of a camshaft to reciprocating motion to open and close the intake and exhaust valves. FIG. 1 illustrates a simplified, pushrod-type internal combustion engine 2 having a crankshaft 4 which is attached to a connecting rod 6 having a piston 8 connected thereto. As fuel ignited in a cylinder, the piston 8 is driven downward from the explosion which in turn, causes the crankshaft 4 to rotate. This rotation of the crankshaft 4 is translated, in a vehicle application, to a transmission and gears which cause the drive tires to rotate. Also, the crankshaft 4 drives a camshaft 10 via a chain or a belt (not shown).

The camshaft 10 has lobes 12, or cams, as depicted FIG. 2. A valve lifter 14, also known as a cam follower, rides on a lobe 12 of the camshaft 10 to translate the rotational motion of the camshaft 10 into a reciprocating motion. The valve lifter is typically machined from high strength stainless steel alloys such as 4130, 4140 or SAE 9310. In a pushrod engine, the valve lifter receives a pushrod 16 which moves up and down with the valve lifter 14. At the opposite end of the pushrod 16 is a rocker arm 18 which acts upon a valve 20. The valve 20 is positioned in a valve spring, not shown, which is situated in a cylinder head that has intake and exhaust openings above the cylinder in which the valves are seated. The cylinder head receives a mixture of air and fuel via an intake manifold from either a fuel injection system or carburetor. When the intake valve 20 opens, the air-fuel mixture passes through the intake port and enter the cylinder for combustion. The resulting spent gases are expelled from the combustion chamber when the exhaust valve opens. The opening and closing of the valve 20 are controlled by the movement of the camshaft 10 which is translated by the valve lifter 14 and pushrod 16. As the valve lifter 14 and pushrod 16 move upward, the rocker arm 18 forces the valve 20 downward, or open. Conversely, as the valve lifter 14 and pushrod 16 move downward, the rocker arm 18 allows the valve 20 to travel up, or closed.

Figure 4:
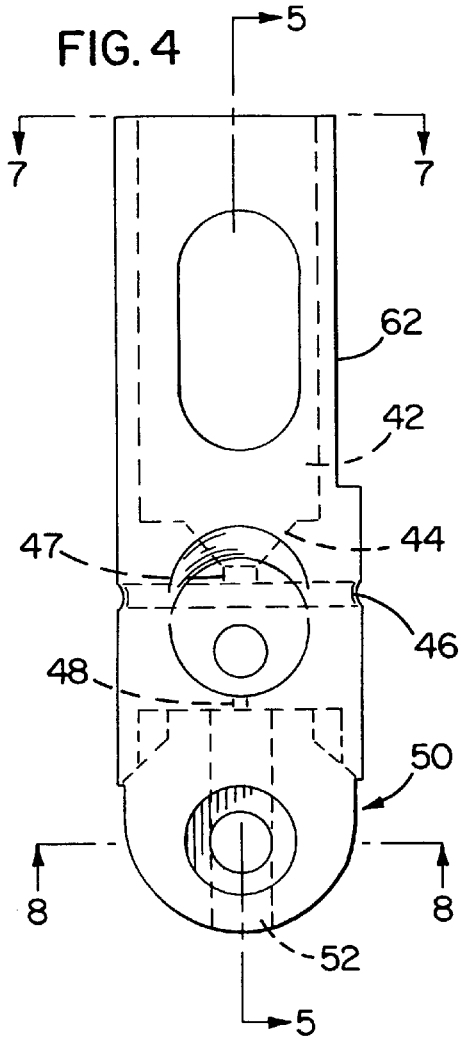
FIG. 4 is an enlarged elevational view of a body of the valve lifter showing oil passageways including an oiling channel and an opening for the bearing assembly.
Figure 7:
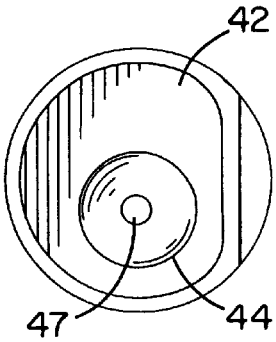
FIG. 7 is a plan view taken along line 7—7 of FIG. 4 showing an upper bore and depression for receiving a pushrod and an oil channel.
Figure 5:
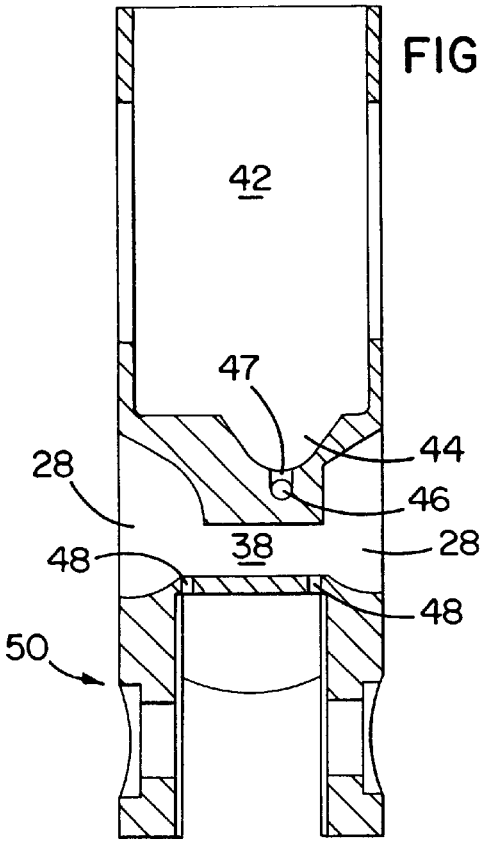
FIG. 5 is a cross-sectional view taken along line 5—5 of FIG. 4 showing the oil passageways and oiling channels leading to a space at the lower end of the body for the rolling member.

As shown in FIG. 2, the valve lifter 14 is positioned in a lifter bore 22 in the engine block 24, The valve lifter 14 receives oil from a common oil passageway 26 in the engine block 24 that communicates with the bores 22. The body of the valve lifter 14 has oil pressure feed receiving areas 28 which are positioned to intersect the common oil passageway 26 as the lifter 14 moves up and down in the bore 22. The lifter 14 also has a roller 30 which rides on the surface of the lobe 12 of the camshaft 10. As seen in FIG. 3, the roller 30 may have a bearing assembly 32 containing needle bearings 34 or alternatively a bushing 35. The roller 30 is rotatively mounted to the valve lifter 14 by a shaft 36. The oil receiving areas 28 positioned on the sides of the valve lifter 14 are connected by a common passageway 38 as seen in FIGS. 3 and 5. The oil passageway 38 may also receive oil from two additional receiving areas 40 on the front and back surfaces of valve lifter 14 that is thrown from the rotating components of the engine. The pushrod 16 which extends into an upper cylindrical bore 42 in the body of the valve lifter 14 and rests in a depression 44 also requires lubrication to reduction friction. An oil passageway 46 traveling through the valve lifter 14 body from the front and back surfaces supplies oil to the pushrod 16 via a vertical channel 47 that connects the oil passageway 46 and the depression 44, as illustrated in FIGS. 4, 5, and 7.

Figure 8:
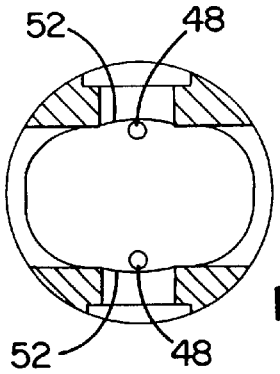
FIG. 8 is a plan view taken along line 8—8 of FIG. 4 showing oiling channels and depressions for directing oil to the opening at the lower portion of the valve lifter for the roller member.
Figure 6:
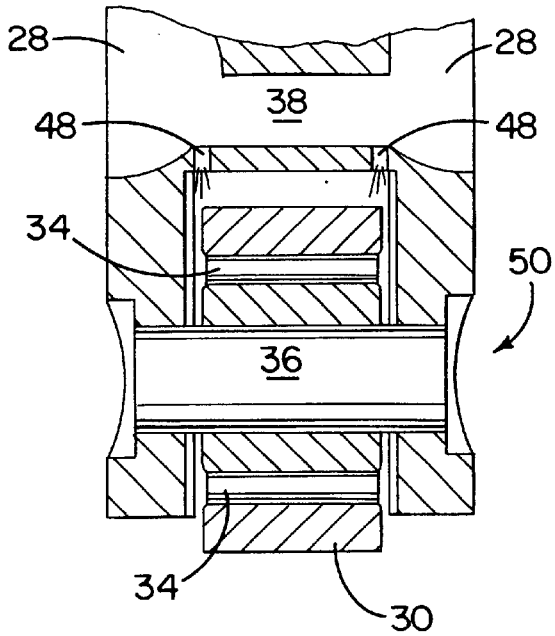
FIG. 6 is an enlarged sectional view of the lower end of the valve lifter body as shown in FIG. 5 including the roller member and bearing assembly mounted thereto with oil being directed through the oiling channels to the roller member.
Figure 9:
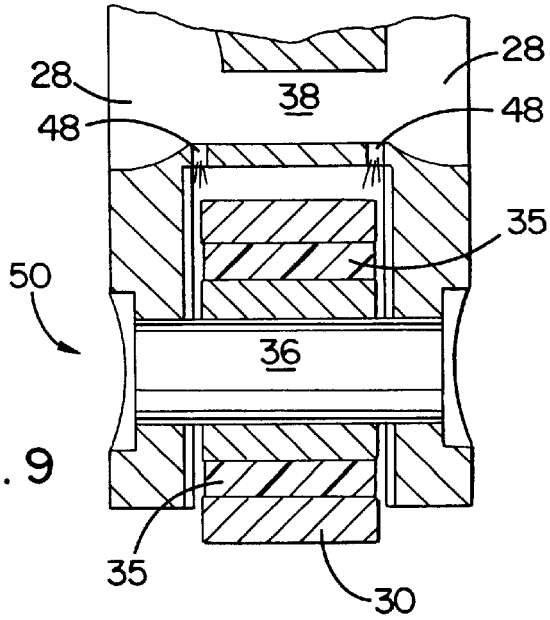
FIG. 9 is an enlarged sectional view of an alternative embodiment of the lower end of the valve lifter body as shown in FIG. 5 including the roller member and a bushing assembly mounted thereto with oil being directed through the oiling channels to the roller member.

In high performance engines, especially those which maintain high engine speeds for long durations, a common area of wear and failure of a valve lifter 14 is at the bearing assembly 32 or bushing 35 of the roller 30. Excessive wear or friction may be the result from inadequate oiling of the roller 30 or in extreme cases, the complete lack of oil to the bearing assembly 32 or bushing 35. To facilitate the movement of lubrication to this area, oiling channels 48 have been added which connect the oil passageway 38 to the housing portion 50 for the roller 30 formed at the lower end of the lifter body. Here, the oil is pressure feed from the common transverse oil passage 26 in the engine block 24 into the oil receiving areas 28 and through the oil channels 48 to the edges of the roller 30. To provide for this increased in flow of oil, a semicircular depression 52 about the width of the opening for the shaft 36 is milled running axially the length of the housing 50. The depression 52 also facilitates the movement of oil from the surface of the lobe 12 of the camshaft 10 to the shaft 36, bearing assembly 32 or bushing 35. FIG. 8 depicts the oil channels 48 and depression 52 as seen from the bottom of valve lifter 14 with the roller 30 removed. As oil exists the oil channels 48, the oil flows down the depression 52 of the housing 50 and lubricates the roller 30, the needle bearings 34 or bushing 35, and the shaft 36 as illustrated in FIGS. 6 and 9.

Valve lifters in high perfomance engines have a tendency to rotate in the lifter bores 22 due to the high engine speeds and mechanical vibrations. To prevent rotation, a link bar which connects two lifters, typically the lifter for exhaust and intake valve is commonly used. However, the bar adds additional moving components to the valve lifter 14 and thereby increasing the likelihood of fatigue. Also, attachment buttons or fasteners must be added to the lifter to attach the link bar. Furthermore, to remove a lifter from the engine when the two lifters are attached together, both lifters must be removed as a pair. This may result in the inadvertent switching of pushrods during reassembly when different length exhaust and intake pushrods are used.

Turning to FIGS. 10–16, to prevent movement of the valve lifter 14, the present invention uses a guide 54 which mounts to the engine block 24. The lifter guide 54 includes a main flat guide portion 55 sized to span the distance between two adjacent lifter bores 22 adjacent lifters at the top of the lifter bore 22 as seen in FIGS. 2 and 11. To physically secure the lifter guide 54 top of the engine block 24, a fastener 56, typically a threaded type fastener, is placed through a slot 58 in a tab portion 59 projecting from an intermediate position along the length of the main flat guide portion 55 away from the bores 22. The lifter guide 54 also has two small crescent-shaped portions 60 that depend from the flat portion 55 out of the plane thereof for extending into the lifter bores 22 as shown in FIGS. 10 and 11. The curvature of curved surface 60*a* the crescent-shaped portion 60 mates with the curvature of the lifter bore 22. Thus the curved surface 60*a* and the guide member portion 55 form a tight fitting shoulder 61 that securely engages against the corner 63 at the junction of the upper end of the bore 22 and the lop of the engine block. In this manner, as the guide member encounters torquing force s that want to twist it out of position and loosen its connection to the block the tight matins engagement between the shoulder and corner will resist these forces to keep the guide member in proper position for guiding and resisting rotation of the lifter body as it reciprocates in the bore 22.

Figure 17:
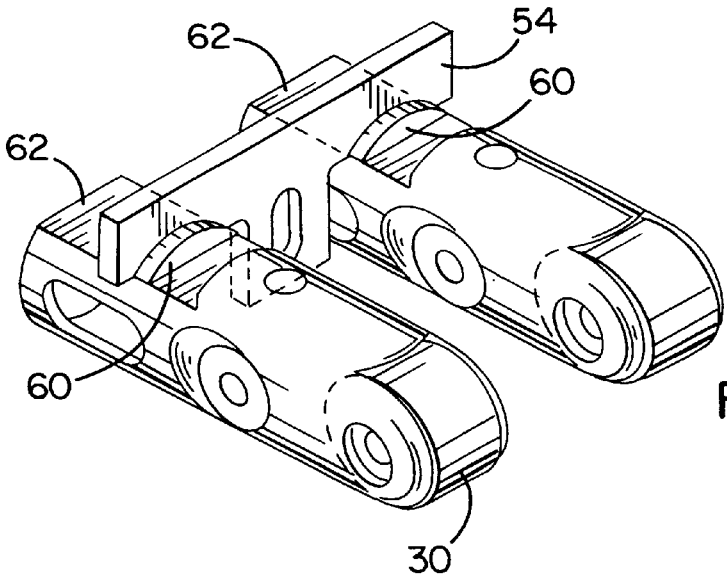
FIG. 17 is a perspective view a pair of valve lifters and the anti-rotation guide showing the portion and the short flat surfaces engaged against the respective flats of the valve lifters.

To this end, a short that surface 60*b* is provided extending between the ends of the curved surfaces 60*a* and faces towards the center of bore 22. A short flat 62 is machined on the front surface of the valve lifter 14 to provide clearance for fitting the crescent-shaped portion 60 of the lifter guide 54 in the bore 22 with the short flat surface 60*b* thereof in confronting relation with the lifter body flat 62 as shown in FIG. 10. Also, the flat 62 must continue axially down the body of the valve lifter 14 for a length that is equal to or greater than the distance the valve lifter 14 travels up and down in the lifter bore 22. However, because the guide flat surfaces 60*b* only extend into the bore 22 a short distance the flat 62 need not extend the entire axial length of the lifter body. FIG. 17 illustrates the portion 60 of the lifter guide 54 engaging the flat 62 of the lifter 14 as it would inside the lifter bore 22. With the crescent-shaped portion 60 in the lifter bore, all movement of the valve lifter 14 is limited to up and down travel, thereby preventing rotation.

Figure 18:
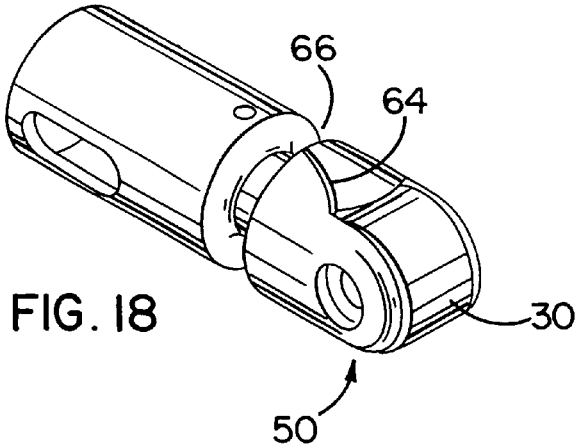
FIG. 18 is a perspective a view of a valve lifter showing an external oiling channel.
Figure 19:
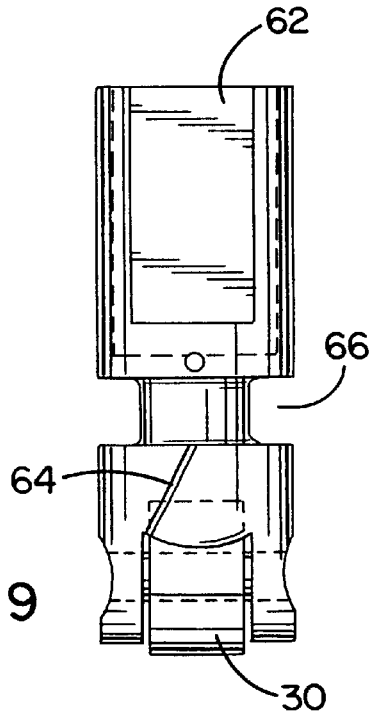
FIG. 19 is an elevational view of the valve lifter showing the diagonal path of the external oiling channel and an oil receiving area.

Another method of providing lubrication to the roller 30 and bearing assembly 32 is by adding an external oiling channels 64 to the lower portion of on front and back surfaces of the lifter body as illustrated in FIGS. 18 and 19. To collect the oil from the transverse oil passageway 26 of the engine block 24, the oil receiving location has been modified by machining an annular grove on the surface of the body above the external oiling channel 64. This annular groove, or annular oil receiving area 66 collects oil as the receiving area 66 passes the transverse oil passageway 26 of the engine block 24. The external oiling channel 64 then directs the oil from the annular oil receiving area 66 to the housing portion 50 of the lifter 14. Here, the depressions 52 in the internal sides of the housing portion 50, as shown in FIGS. 4 and 8, further facilitate the movement of oil to the bearings 34 or alternatively, a bushing 35 and the shaft 36. One advantage of utilizing an the external oiling channels 64 is that less machining is required than that of the internal oil passageways and oiling channels used in the first method. The body of the lifter 14 may be cylindrical as shown in FIG. 18 and used with a link bar to prevent rotation in the lifter bore 22. Alternatively, the lifter may also incorporate the flat 62 as shown in FIG. 19 and utilized with the anti-rotation lifter guide 54.

The external oiling channel 64 is positioned diagonally across the surface of the lifter 14, however, alterative orientations may also be used to achieve the desired results. For example, the external oiling channel 64 could travel axially from the annular oil receiving area 66 to the housing portion 50. However, for ease of manufacturing, the diagonal position is preferred to prevent external oiling channel 64 from catching the tooling during machining and polishing of the lifter body.

The invention described in the above detailed description is not intended to be limited to the specific form set forth herein, but on the contrary it is intended to cover such alternatives, modifications and equivalents as can reasonably be included in within the spirit and scope of the appended claims.

I claim:

1. A valve lifter for interconnecting a camshaft to a valve, the valve lifter comprising;

a body having a lower substantially solid portion extending along a longitudinal axis and an upper substantially hollow portion;

a cylindrical roller member rotatively mounted to the body lower portion for engaging the camshaft and rotating about an axis of rotation thereof transverse to the longitudinal axis and having a first surface and an opposing second surface perpendicular to the axis of rotation thereof;

a bearing member in the roller for assisting the rotation of the roller about an axis having a first and a second surface perpendicular to the axis of rotation of the cylindrical roller member;

a pair of oil holding locations on a first interior surface and a second opposing interior surface of the body lower portion;

an oil passageway extending through the body transverse to the longitudinal axis and parallel with the axis of rotation of the cylindrical roller member for receiving oil; and a pair of oiling channels for directing lubrication from the oil passageway to the oil holding locations for providing oil to the first and second surfaces of the cylindrical roller member and the first and second surfaces of the bearing member therein.

2. The valve lifter of claim 1 wherein the first and second oil holding locations are grooves on the interior surfaces of the first and second surfaces of the body lower portion extending perpendicular to the axis of rotation of the cylindrical roller member and is adjacent to the first and second surfaces of the cylindrical roller member.

3. The valve lifter of claim 1 wherein the first surface and the second surface of the bearing assembly, axle and the first and second surfaces of the cylindrical roller member receives oil from the oil holding locations.

* * * * *